US009223258B2

(12) United States Patent
Kondo

(10) Patent No.: US 9,223,258 B2
(45) Date of Patent: Dec. 29, 2015

(54) FIXING DEVICE, IMAGE FORMING APPARATUS AND OBLIQUE MOTION RESTRAINT MEMBER FOR A FIXING BELT

(71) Applicant: KYOCERA Document Solutions Inc., Osaka (JP)

(72) Inventor: Akihiro Kondo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/134,639

(22) Filed: Dec. 19, 2013

(65) Prior Publication Data

US 2014/0178113 A1 Jun. 26, 2014

(30) Foreign Application Priority Data

Dec. 26, 2012 (JP) ..... 2012-283313

(51) Int. Cl.
*G03G 15/20* (2006.01)

(52) U.S. Cl.
CPC ..... *G03G 15/2003* (2013.01); *G03G 15/2053* (2013.01)

(58) Field of Classification Search
CPC ..... G03G 15/0105; G03G 15/2003; G03G 15/2017; G03G 15/2053; G03G 2215/00143; G03G 2215/00151
USPC ..... 399/329, 67, 122, 320
See application file for complete search history.

(56) References Cited

U.S. PATENT DOCUMENTS

| | | | | |
|---|---|---|---|---|
| 2008/0003026 | A1* | 1/2008 | Seol | 399/329 |
| 2010/0054827 | A1* | 3/2010 | Carr et al. | 399/329 |
| 2013/0164056 | A1* | 6/2013 | Imada et al. | 399/329 |
| 2013/0192959 | A1* | 8/2013 | Kitamura | 198/806 |

FOREIGN PATENT DOCUMENTS

JP 2006-313256 11/2006

* cited by examiner

*Primary Examiner* — Benjamin Schmitt
*Assistant Examiner* — Matthew Miller
(74) *Attorney, Agent, or Firm* — Wenderoth, Lind & Ponack, L.L.P.

(57) ABSTRACT

A fixing device includes a fixing belt configured to rotate about a specified rotation axis, and an oblique motion restraint member provided at an outer side of the fixing belt in a direction of the rotation axis and configured to restrain oblique motion of the fixing belt. The oblique motion restraint member includes a contact portion provided to make contact with an end surface of the fixing belt and a breakage-preventing portion provided radially inward of the contact portion and more outward in the direction of the rotation axis than the contact portion. The contact portion bulges in an arcuate cross-sectional shape toward an inner side in the direction of the rotation axis.

5 Claims, 7 Drawing Sheets

FIXING DEVICE, IMAGE FORMING APPARATUS AND OBLIQUE MOTION RESTRAINT MEMBER FOR A FIXING BELT

CROSS-REFERENCE TO RELATED APPLICATIONS

This application is based upon and claims the benefit of priority from Japanese Patent Application No. 2012-283313 filed on Dec. 26, 2012, the entire contents of which are incorporated herein by reference.

BACKGROUND

The technology of the present disclosure relates to a fixing device for fixing a toner image to a paper, an image forming apparatus provided with the fixing device, and an oblique motion restraint member for a fixing belt installed in the fixing device.

A fixing device for fixing a toner image to a paper is installed in an electro-photographic image forming apparatus such as a copier, a printer or the like. As a fixing method employed in the fixing device, a "thermal roller method" in which a toner image is fixed to a paper in a fixing nip formed between a pair of rotatable rollers is extensively used from the viewpoint of thermal efficiency and safety. In the meantime, there is a demand for the shortening of a warm-up time and the energy saving. Thus, attention is recently paid to a "belt method" in which a fixing nip is formed using a rotatable fixing belt installed around one or more rollers.

In the belt method, due to the misalignment of rollers around which a fixing belt is installed, it is often the case that a force acting outward in a direction of a rotation axis of the fixing belt is applied to the fixing belt during rotation of the fixing belt, thereby causing the fixing belt to be obliquely moved. If the oblique motion becomes severe, a problem of the fixing belt interfering with other members is likely to occur.

Thus, there is known a configuration in which an oblique motion restraint member is disposed at an outer side of a fixing belt in a direction of a rotation axis and is brought into contact with an end surface of the fixing belt to thereby restrain oblique motion of the fixing belt. However, if the oblique motion restraint member is brought into contact with the end surface of the fixing belt, the end surface of the fixing belt is repeatedly pressed by the oblique motion restraint member during rotation of the fixing belt, consequently generating a crack on the end surface of the fixing belt. This may lead to breakage of the fixing belt. In particular, a fixing-nip-adjoining portion of the end surface of the fixing belt is deformed along with the formation of the fixing nip. Therefore, the aforementioned crack is easily generated.

Under these circumstances, there has been proposed a configuration for avoiding the problems noted above. This configuration will be described below with reference to FIG. 7.

A fixing device 51 includes a fixing roller 52, a fixing belt 53 installed around the fixing roller 52, a pressing roller 55 pressed against the fixing belt 53 to form a fixing nip 54 between the fixing belt 53 and the pressing roller 55, and an oblique motion restraint member 56 installed at an outer side of the fixing belt 53 in a direction of a rotation axis Y. The oblique motion restraint member 56 includes a contact portion 57 capable of making contact with an end surface 59 of the fixing belt 53 and a breakage-preventing portion 58 installed radially inward of the contact portion 57. If the portion of the fixing belt 53 existing at the side of the fixing nip 54 becomes smaller in diameter along with the formation of the fixing nip 54, a fixing-nip-adjoining portion 59*a* of the end surface 59 of the fixing belt 53 moves from the contact portion 57 toward the breakage-preventing portion 58. Thus, the fixing-nip-adjoining portion 59*a* of the end surface 59 of the fixing belt 53 is prevented from being excessively pressed by the oblique motion restraint member 56.

However, the frictional resistance between the end surface 59 of the fixing belt 53 and the contact portion 57 of the oblique motion restraint member 56 is large because the contact portion 57 of the oblique motion restraint member 56 is formed into a planar shape and because the end surface 59 of the fixing belt 53 makes thorough contact with the contact portion 57 of the oblique motion restraint member 56. For that reason, even if the portion of the fixing belt 53 existing at the side of the fixing nip 54 becomes smaller in diameter along with the formation of the fixing nip 54, the fixing-nip-adjoining portion 59*a* of the end surface 59 of the fixing belt is expanded radially outward without moving from the contact portion 57 toward the breakage-preventing portion 58. In this state, if the fixing-nip-adjoining portion 59*a* of the end surface 59 of the fixing belt 53 is repeatedly pressed by the oblique motion restraint member 56 during rotation of the fixing belt 53, a crack is prematurely generated on the end surface 59 of the fixing belt 53. This may lead to breakage of the fixing belt 53.

SUMMARY

A fixing device according to one aspect of the present disclosure includes a fixing belt configured to rotate about a specified rotation axis, and an oblique motion restraint member provided at an outer side of the fixing belt in a direction of the rotation axis and configured to restrain oblique motion of the fixing belt. The oblique motion restraint member includes a contact portion provided to make contact with an end surface of the fixing belt and a breakage-preventing portion provided radially inward of the contact portion and more outward in the direction of the rotation axis than the contact portion. The contact portion bulges in an arcuate cross-sectional shape toward an inner side in the direction of the rotation axis.

An oblique motion restraint member for a fixing belt according to another aspect of the present disclosure is provided at an outer side of the fixing belt in a direction of a specified rotation axis about which the fixing belt rotates. The oblique motion restraint member includes a contact portion provided to make contact with an end surface of the fixing belt, and a breakage-preventing portion provided radially inward of the contact portion and more outward in the direction of the rotation axis than the contact portion. The contact portion bulges in an arcuate cross-sectional shape toward an inner side in the direction of the rotation axis.

DETAILED DESCRIPTION

Figure 1:
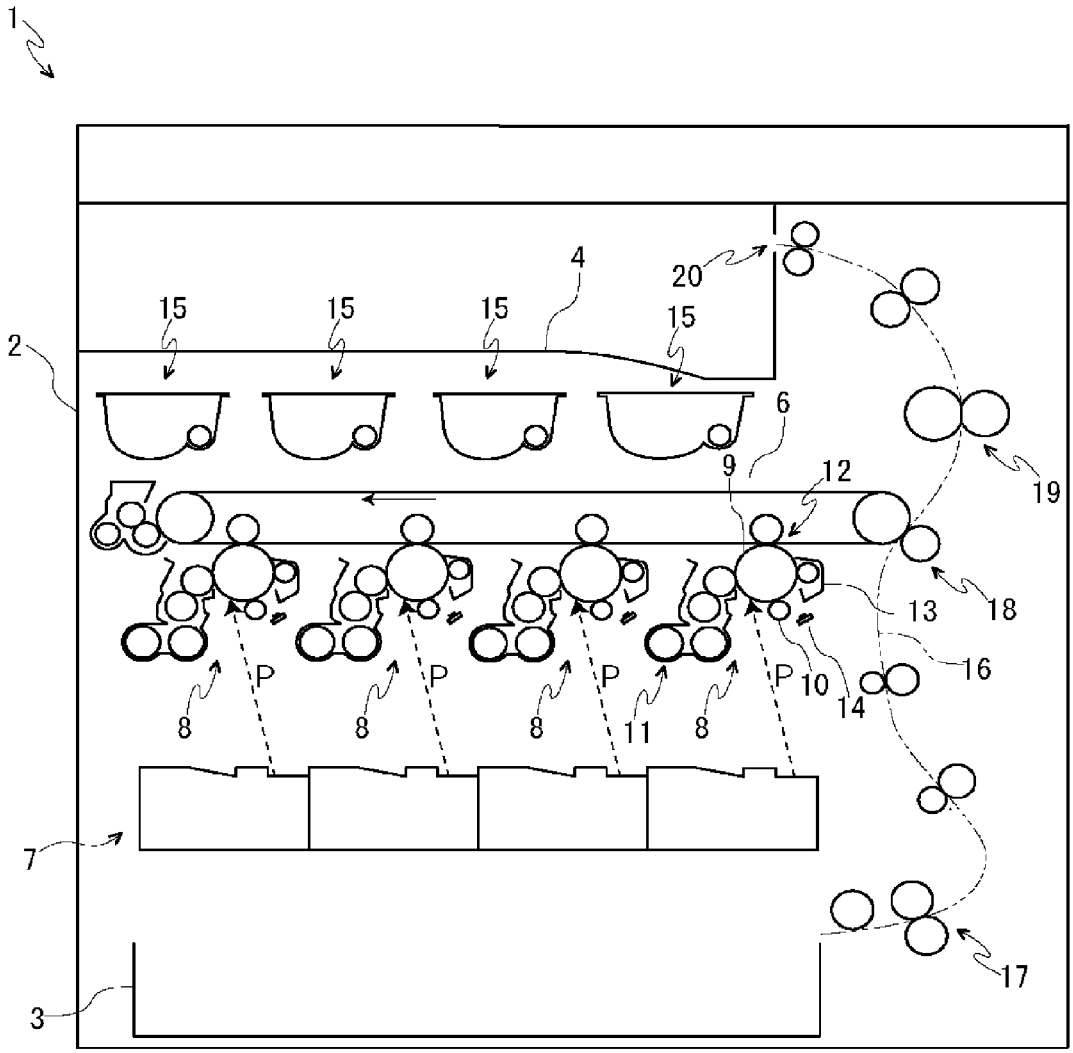
FIG. 1 is a schematic diagram showing an outline of a configuration of a color printer according to one embodiment.

First, an overall configuration of a color printer 1 as an image forming apparatus will be described with reference to FIG. 1. FIG. 1 is a schematic diagram showing an outline of a configuration of a color printer according to one embodiment.

The color printer 1 is provided with a box-shaped printer body 2. A paper feeding cassette 3 which retains papers (not shown) therein is installed below the printer body 2. A paper discharge tray 4 is installed above the printer body 2.

In the central area of the printer body 2, an intermediate transfer belt 6 is stretched between rollers. An exposure device 7 formed of a laser scanning unit (LSU) is arranged below the intermediate transfer belt 6. In the vicinity of the intermediate transfer belt 6, four image forming units 8 are installed along a lower portion of the intermediate transfer belt 6 with respect to individual toner colors (e.g., four colors of magenta, cyan, yellow and black). A photosensitive drum 9 is rotatably installed in each of the image forming units 8. Around the photosensitive drum 9, a charging unit 10, a developing unit 11, a primary transfer unit 12, a cleaning unit 13 and an electricity removing unit are arranged in an order of a primary transfer process. Toner containers 15 corresponding to the respective image forming units 8 are installed above the developing units 11 with respect to individual toner colors.

A paper conveying route 16 is provided at one side (the right side in FIG. 1) of the printer body 2. A paper feeding unit 17 is installed in an upstream end of the paper conveying route 16. A secondary transfer unit 18 is installed at one end (the right end in FIG. 1) of the intermediate transfer belt 6 in a midstream portion of the paper conveying route 16. A fixing device 19 is installed in a downstream portion of the paper conveying route 16. A paper discharge port 20 is installed at a downstream end of the paper conveying route 16.

Next, description will be made on an image forming operation of the color printer 1 configured as above. If power is supplied to the color printer 1, different kinds of parameters are initialized and initial setting such as temperature setting of the fixing device 19 or the like is performed. If image data are inputted from a computer connected to the color printer 1 and if a printing start instruction is issued, an image forming operation is performed in the following manner.

First, the surface of the photosensitive drum 9 is electrically charged by the charging unit 10 and, then, an electrostatic latent image is formed on the surface of the photosensitive drum 9 by the laser light (see arrows P) emitted from the exposure device 7. Subsequently, the developing unit 11 develops the electrostatic latent image into a toner image of the corresponding color using a toner supplied from one of the toner containers 15. In the primary transfer unit 12, the toner image is transferred to the surface of the intermediate transfer belt 6. The respective image forming units 8 sequentially repeat the aforementioned operation, whereby a full-color toner image is formed on the intermediate transfer belt 6. The toners and the electric charges remaining on the photosensitive drum 9 are removed by the cleaning unit 13 and the electricity removing unit 14.

In the meantime, a paper taken out by the paper feeding unit 17 from the paper feeding cassette 3 or a manual feeding tray (not shown) is conveyed to the secondary transfer unit 18 at a synchronized timing with the aforementioned image forming operation. In the secondary transfer unit 18, the full-color toner image existing on the intermediate transfer belt 6 is secondarily transferred to the paper. The paper to which the toner image is secondarily transferred is conveyed toward the downstream side of the paper conveying route 16. The paper enters the fixing device 19 where the toner image is fixed to the paper. The paper to which the toner image is fixed is discharged from the discharge port 20 onto the paper discharge tray 4.

Figure 2:
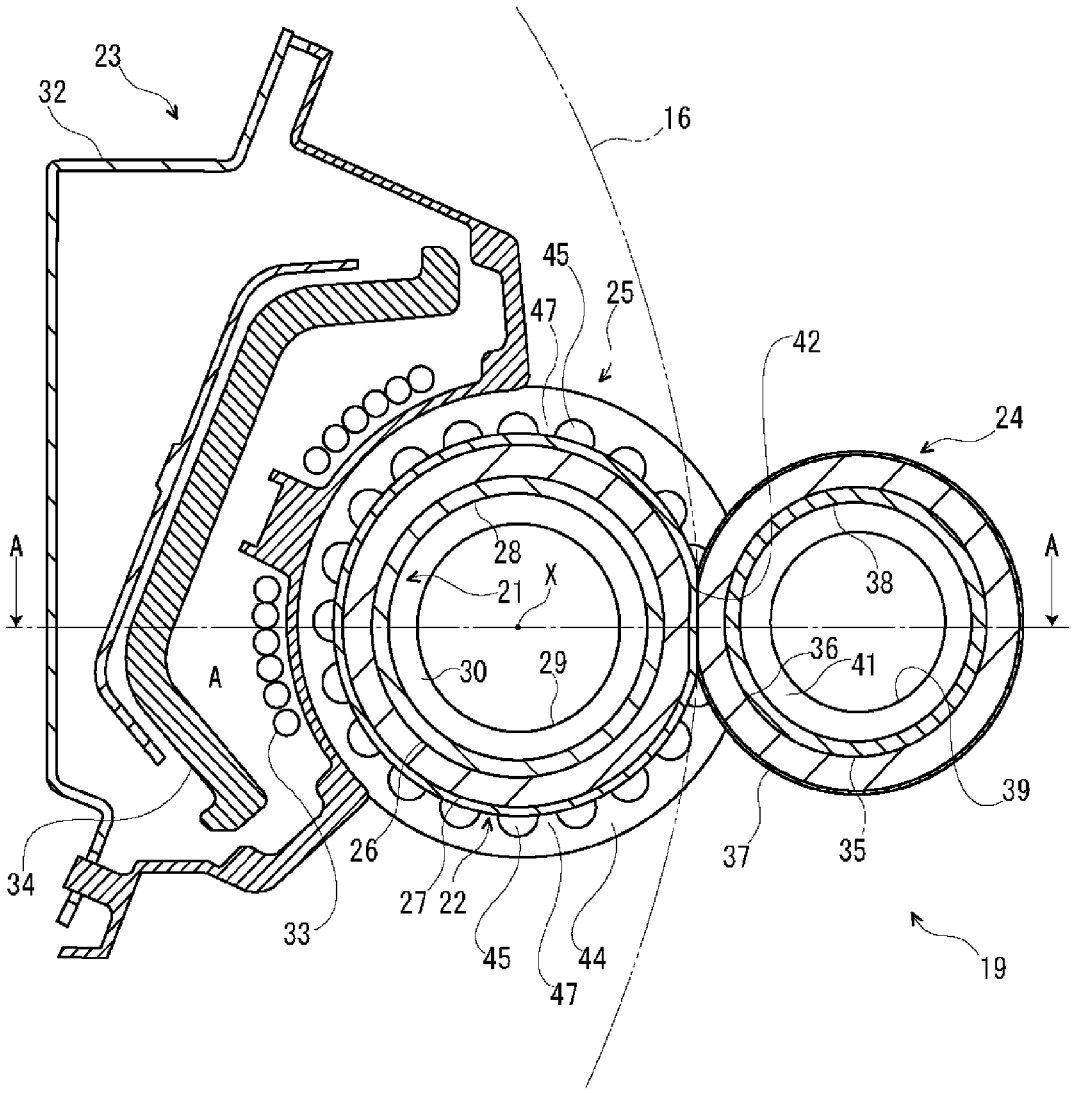
FIG. 2 is a sectional view showing a fixing device employed in the color printer according to one embodiment.
Figure 3:
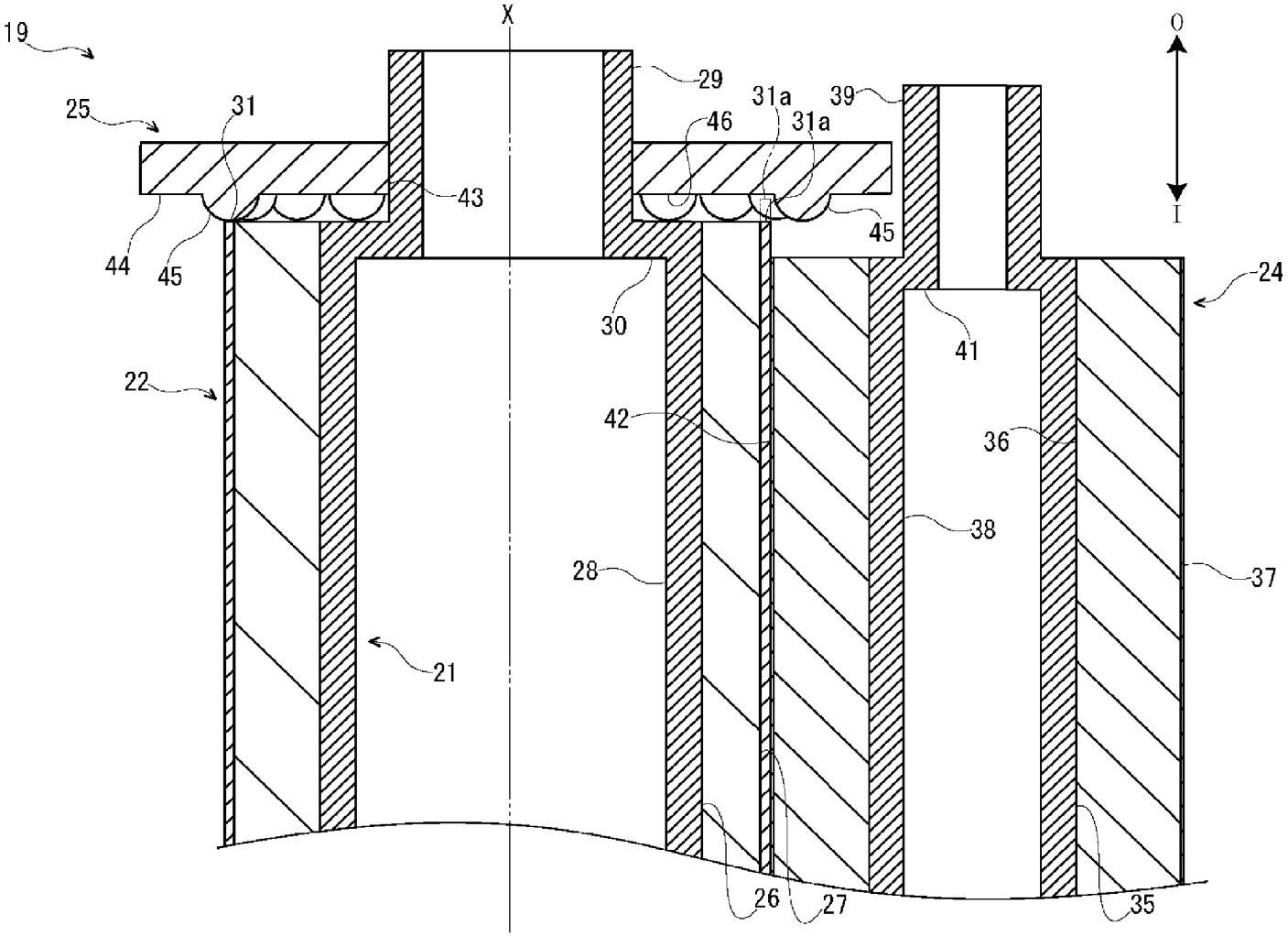
FIG. 3 is a sectional view of the fixing device employed in the color printer according to one embodiment, which is taken along line A-A in FIG. 2.

Next, the fixing device 19 will be described in detail. In FIGS. 2 and 3, there is shown only the front one of a pair of configurations arranged at the front and rear sides.

As shown in FIGS. 2 and 3, the fixing device 19 includes a fixing roller 21, a fixing belt 22 installed around the fixing roller 21, an IH fixing unit 23 (not shown in FIG. 3) installed at the left side of the fixing belt 22, a pressing roller 24 installed at the right side of the fixing belt 22, and oblique motion restraint members 25 installed at the front and rear end sides of the fixing roller 21 and the fixing belt 22. These components will now be described one after another.

First, description will be made on the fixing roller 21. The fixing roller 21 has a shape elongated in a front-rear direction (a thickness direction of a drawing sheet in FIG. 2 or an up-down direction in FIG. 3). The fixing roller 21 is connected to a drive source (not shown) such as a motor or the like. The fixing roller 21 is configured such that, as a torque is delivered from the drive source to the fixing roller 21, the fixing roller 21 rotates about a rotation axis X extending in the front-rear direction. That is to say, in the present embodiment, the front-rear direction is the direction of the rotation axis X. An arrow I shown in FIGS. 3 to 6 indicates the inner side in the front-rear direction (the direction of the rotation axis X). An arrow O shown in FIGS. 3 to 6 indicates the outer side in the front-rear direction (the direction of the rotation axis X).

As shown in FIGS. 2 and 3, the fixing roller 21 is composed of, e.g., a core member 26 and an elastic layer 27 installed around the core member 26. The core member 26 of the fixing roller 21 is made of, e.g., a metal such as stainless steel or aluminum. The core member 26 of the fixing roller 21 includes a cylindrical main tube portion 28 and auxiliary tube portions 29 installed in the front and rear end portions of the main tube portion 28. Since the inner and outer diameters of the main tube portion 28 are larger than the inner and outer diameters of the auxiliary tube portions 29, step portions 30 are formed between the main tube portion 28 and the auxiliary tube portions 29. The auxiliary tube portions 29 are arranged more outward in the front-rear direction than the elastic layer 27 of the fixing roller 21 and the fixing belt 22.

The elastic layer 27 of the fixing roller 21 is formed into a cylindrical shape and is made of, e.g., a foamed rubber. The length in the front-rear direction of the elastic layer 27 of the fixing roller 21 is substantially equal to the length in the front-rear direction of the main tube portion 28 of the core member 26 of the fixing roller 21.

Next, description will be made on the fixing belt 22. The fixing belt 22 has a shape elongated in the front-rear direction. The length in the front-rear direction of the fixing belt 22 is substantially equal to the length in the front-rear direction of the main tube portion 28 of the core member 26 of the fixing roller 21. The fixing belt 22 is configured such that, along with the rotation of the fixing roller 21, the fixing belt 22 rotates about the rotation axis X together with the fixing roller 21. That is to say, the fixing roller 21 and the fixing belt 22 have the same rotation axis.

The fixing belt 22 is composed of, e.g., a base material layer, an elastic layer installed around the base material layer and a mold release layer covering the elastic layer. The base material layer of the fixing belt 22 is made of, e.g., a metal such as nickel or the like. The elastic layer of the fixing belt 22 is made of, e.g., a silicon rubber. The mold release layer of the fixing belt 22 is made of, e.g., a fluororesin such as PFA or the like. In FIGS. 2 and 3, the respective layers (the base material layer, the elastic layer and the mold release layer) of the fixing belt 22 are not specifically distinguished from one another. In the following description, the end surfaces of the respective layers of the fixing belt 22 will be generally referred to as an "end surface 31 of the fixing belt 22".

Next, description will be made on the IH fixing unit 23. As shown in FIG. 2, the IH fixing unit 23 includes a case member 32, an IH coil 33 arranged within the case member 32 and installed in an arc shape along an outer circumference of the fixing belt 22, and an arch core 34 arranged within the case member 32 and installed along an outer circumference of the IH coil 33. Upon supplying a high-frequency current to the IH coil 33, high-frequency magnetic fields are generated in the IH coil 33. The fixing belt 22 is heated by the high-frequency magnetic fields.

Next, description will be made on the pressing roller 24. The pressing roller 24 has a shape elongated in the front-rear direction. The pressing roller 24 is composed of a cylindrical core member 35, an elastic layer 36 installed around the core member 35 and a mold release layer 37 covering the elastic layer 36. The core member 35 of the pressing roller 24 is made of, e.g., a metal such as stainless steel or aluminum. The core member 35 of the pressing roller 24 includes a cylindrical large-diameter portion 38 and small-diameter portions 39 installed in the front and rear end portions of the large-diameter portion 38. Since the inner and outer diameters of the large-diameter portion 38 are larger than the inner and outer diameters of the small-diameter portions 39, step portions 41 are formed between the large-diameter portion 38 and the small-diameter portions 39. The elastic layer 36 of the pressing roller 24 is made of, e.g., a silicon rubber or a silicon sponge. The mold release layer 37 of the pressing roller 24 is formed of, e.g., a PFA tube.

The pressing roller 24 is pressed against fixing belt 22 by a biasing force of a biasing means (not shown). The pressing roller 24 is configured such that, along with the rotation of the fixing roller 21 and the fixing belt 22, the pressing roller 24 is passively rotated in a direction opposite to the rotation direction of the fixing roller 21 and the fixing belt 22. A fixing nip 42 is formed between the fixing belt 22 and the pressing roller 24 along the paper conveying route 16. As the paper passes through the fixing nip 42, the toner image on paper is fixed to the paper by heating and pressing.

Figure 4A:
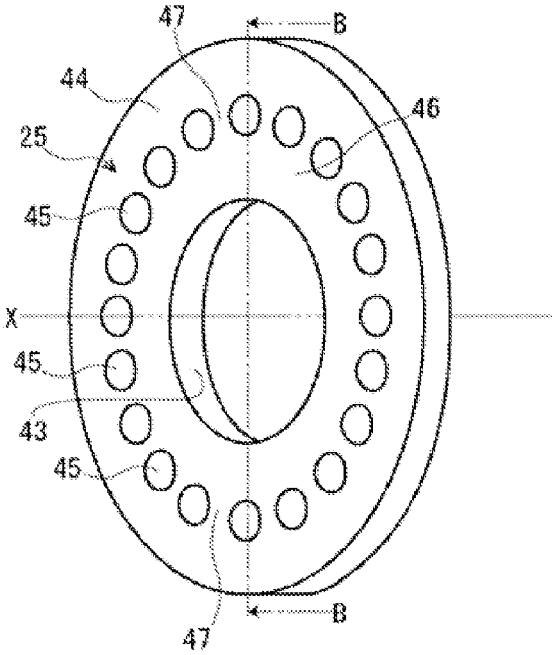
FIG. 4A is a perspective view showing an oblique motion restraint member employed in the fixing device of the color printer according to one embodiment.
Figure 4B:
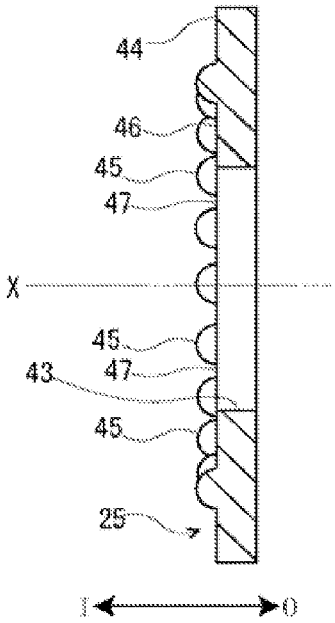
FIG. 4B is a sectional view taken along line B-B in FIG. 4A.

Next, description will be made on the oblique motion restraint members 25. The respective oblique motion restraint members 25 are installed at the front and rear sides (the outer sides in the direction of the rotation axis X) of the fixing belt 22. As shown in FIG. 4, each of the oblique motion restraint members 25 has a substantially flat plate shape. A circular fastening hole 43 is formed at the center of each of the oblique motion restraint members 25. The fastening hole 43 is fitted to each of the auxiliary tube portions 29 of the core member 26 of the fixing roller 21. Thus, the respective oblique motion restraint members 25 are fastened to the front and rear end portions (the opposite end portions in the direction of the rotation axis X) of the fixing roller 21 (see FIG. 3).

As shown in FIG. 4, a plurality of (e.g., twenty) contact portions 45 is circumferentially arranged side by side about the rotation axis X on an inner surface 44 of each of the oblique motion restraint members 25 (on a rear surface in case of the front oblique motion restraint member 25 or a front surface in case of the rear oblique motion restraint member 25, namely an inner surface in the front-rear direction of each of the oblique motion restraint members 25). For that reason, depressions and protrusions are successively formed along a circle about the rotation axis X on the inner surface 44 of each of the oblique motion restraint members 25. The respective contact portions 45 are installed with a gap 47 left therebetween.

Each of the contact portions 45 protrudes in a hemispheric shape (a bowl shape) from the inner surface 44 of each of the oblique motion restraint members 25. Thus, each of the contact portions 45 bulges in an arcuate cross-sectional shape toward the inner side in the front-rear direction. The term "hemispheric shape" used herein encompasses not only a shape obtained by cutting a sphere along a plane passing through the center of the sphere but also a shape obtained by cutting a sphere along a plane not passing through the center of the sphere. In addition, the term "hemispheric shape" encompasses not only a shape obtained by cutting a true sphere (a sphere which is constant in the distance from the center to the surface thereof) but also a shape obtained by cutting an oval sphere (a sphere which is not constant in the distance from the center to the surface thereof).

As shown in FIG. 4, an annular breakage-preventing portion 46 is formed on the inner surface 44 of each of the oblique motion restraint members 25 at a radial inner side (at a side nearer to the rotation axis X) of each of the contact portions 45. The breakage-preventing portion 46 has a planar shape. The breakage-preventing portion 46 is disposed more outward in the front-rear direction (more frontward in case of the front oblique motion restraint member 25 or more rearward in case of the rear oblique motion restraint member 25) than the respective contact portions 45 (see FIG. 3).

In the fixing device 19 configured as above, when the fixing nip 42 is formed (when the pressing roller 24 is pressed against the fixing belt 22), a fixing-nip-adjoining portion 31*a* of the end surface 31 of the fixing belt 22 faces toward the breakage-preventing portion 46 of each of the oblique motion restraint members 25. Furthermore, the portion of the end surface 31 of the fixing belt 22 other than the fixing-nip-adjoining portion 31*a* makes contact with the respective contact portions 45 of each of the oblique motion restraint members 25.

In this state, if a torque is delivered from a drive source (not shown) to the fixing roller 21 and if the fixing roller 21 is rotated resultantly, the fixing belt 22 installed around the fixing roller 21 rotates together with the fixing roller 21. Accordingly, a force acting outward in the front-rear direction is generated in the fixing belt 22, whereby the fixing belt 22 tends to make an oblique motion. However, since the portion of the end surface 31 of the fixing belt 22 other than the fixing-nip-adjoining portion 31*a* makes contact with the respective contact portions 45 of each of the oblique motion restraint members 25, the fixing belt 22 is restrained from moving outward in the front-rear direction and is prevented from making an oblique motion. It is therefore possible to prevent occurrence of a problem that the oblique motion of the fixing belt 22 becomes severe and the fixing belt 22 interferes with other members.

By the way, if the oblique motion of the fixing belt 22 is restrained by the oblique motion restraint members 25 as mentioned above, the fixing-nip-adjoining portion 31*a* of the end surface 31 of the fixing belt 22 is repeatedly pressed by the oblique motion restraint members 25 during rotation of the fixing belt 22, which may generate a crack on the end surface 31 of the fixing belt 22. The generation of the crack on the end surface 31 of the fixing belt 22 may lead to breakage of the fixing belt 22.

However, as set forth above, when the fixing nip 42 is formed, the fixing-nip-adjoining portion 31*a* of the end surface 31 of the fixing belt 22 faces toward the breakage-preventing portion 46 without making contact with the contact portions 45 of each of the oblique motion restraint members 25 (see FIG. 3). For that reason, if a force acting outward in the front-rear direction is generated in the fixing belt 22 during rotation of the fixing belt 22, the fixing-nip-adjoining portion 31*a* of the end surface 31 of the fixing belt moves outward in the front-rear direction toward the breakage-preventing portion 46 as indicated by a single-dot chain line in FIG. 3, thereby absorbing the force acting outward in the front-rear direction. This makes it possible to prevent the fixing-nip-adjoining portion 31*a* of the end surface 31 of the fixing belt 22 from being excessively pressed by each of the oblique motion restraint members 25. Thus, it becomes possible to suppress generation of a crack on the end surface 31 of the fixing belt 22 and to prevent breakage of the fixing belt 22.

Figure 5:
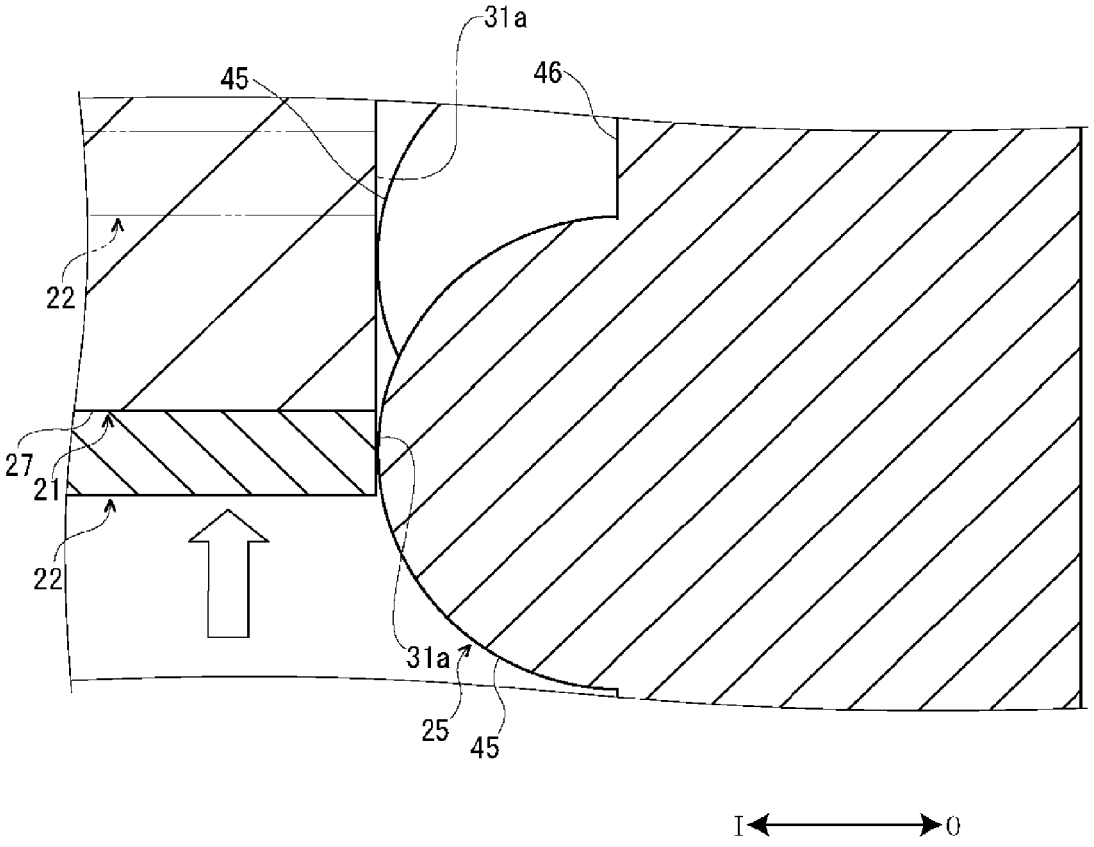
FIG. 5 is a sectional view showing a contact area of a fixing-nip-adjoining portion of an end surface of a fixing belt and a contact portion of an oblique motion restraint member prior to forming a fixing nip in the fixing device of the color printer according to one embodiment.

In the fixing device 19 configured as above, prior to forming the fixing nip 42, the fixing-nip-adjoining portion 31*a* of the end surface 31 of the fixing belt 22 makes contact with the contact portions 45 of each of the oblique motion restraint members 25 as shown in FIG. 5. In this state, if the fixing nip 42 is formed by pressing the pressing roller 24 against the fixing belt 22, the fixing belt 22 is pressed by the pressing roller 24 (not shown in FIG. 5) as indicated by a void arrow. Accordingly, the elastic layer 27 of the fixing roller 21 is compressed and, as indicated by a two-dot chain line in FIG. 5, the portion of the fixing belt 22 existing at the side of the fixing nip 42 becomes smaller in diameter. Thus, the fixing-nip-adjoining portion 31*a* of the end surface 31 of the fixing belt 22 moves radially inward. This releases the contact between the fixing-nip-adjoining portion 31*a* of the end surface 31 of the fixing belt 22 and the contact portions 45 of each of the oblique motion restraint members 25. The fixing-nip-adjoining portion 31*a* of the end surface 31 of the fixing belt 22 faces toward the breakage-preventing portion 46 of each of the oblique motion restraint members 25.

In the present embodiment, each of the contact portions of the oblique motion restraint members 25 bulges in an arcuate cross-sectional shape toward the inner side in the front-rear direction. Therefore, as compared with a case where each of the contact portions 45 is formed into a planar shape, it is possible to reduce the contact area of each of the contact portions 45 and the end surface 31 of the fixing belt 22, which makes it possible to reduce the frictional resistance between each of the contact portions 45 and the end surface 31 of the fixing belt 22. For that reason, along with the formation of the fixing nip 42, the fixing-nip-adjoining portion 31*a* of the end surface 31 of the fixing belt 22 can be reliably moved from the contact portions 45 to the breakage-preventing portion 46 and can be caused to face toward the breakage-preventing portion 46. It is therefore possible to restrain the fixing-nip-adjoining portion 31*a* of the end surface 31 of the fixing belt 22 from being pressed by each of the oblique motion restraint members 25 during rotation of the fixing belt 22. This makes it possible to prevent breakage of the fixing belt 22.

The respective contact portions 45 protrude in a hemispheric shape from the inner surface 44 (the surface existing at the inner side in the front-rear direction) of each of the oblique motion restraint members 25 and are circumferentially arranged side by side about the rotation axis X. Thus, the apex of each of the contact portions 45 and the end surface 31 of the fixing belt 22 make substantially point-to-point contact with each other. Therefore, as compared with a case where the apex of each of the contact portions 45 and the end surface 31 of the fixing belt 22 make substantially line-to-line contact with each other (e.g., a case where the respective contact portions 45 form an annular shape), it is possible to reduce the contact area of each of the contact portions 45 and the end surface 31 of the fixing belt 22. Accordingly, it is possible to further reduce the frictional resistance between each of the contact portions 45 and the end surface 31 of the fixing belt 22. Along with the formation of the fixing nip 42, the fixing-nip-adjoining portion 31*a* of the end surface 31 of the fixing belt 22 can be reliably moved from the contact portions 45 to the breakage-preventing portion 46 and can be caused to face toward the breakage-preventing portion 46.

The respective contact portions 45 are installed with the gap 47 left therebetween. Therefore, as compared with a case where the respective contact portions 45 are installed without leaving the gap 47 therebetween, it is possible to reduce the number of the contact portions 45 and to further reduce the contact area of the respective contact portions 45 and the end surface 31 of the fixing belt 22. For that reason, along with the formation of the fixing nip 42, the fixing-nip-adjoining portion 31*a* of the end surface 31 of the fixing belt 22 can be more reliably moved from the contact portions 45 to the breakage-preventing portion 46 and can be caused to face toward the breakage-preventing portion 46.

The fixing belt 22 is installed around the fixing roller 21, and the oblique motion restraint members 25 are fastened to the front and rear end portions of the fixing roller 21. By employing this configuration, it is possible to restrain the oblique motion of the fixing belt 22 with a simple configuration.

Figure 6A:
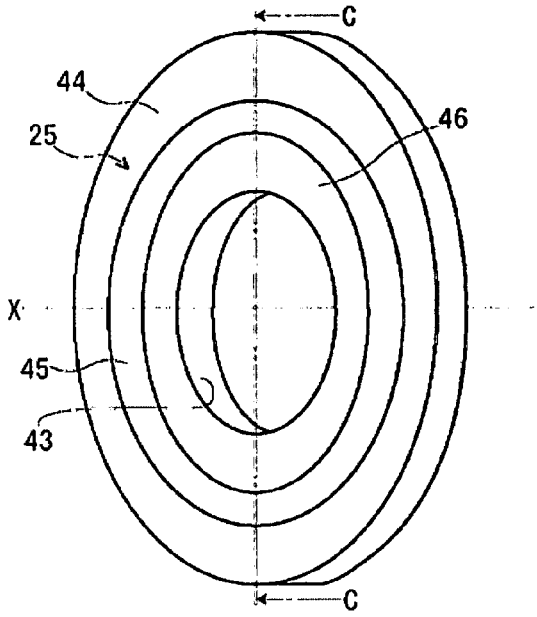
FIG. 6A is a perspective view showing an oblique motion restraint member employed in a fixing device of a color printer according to another embodiment.
Figure 6B:
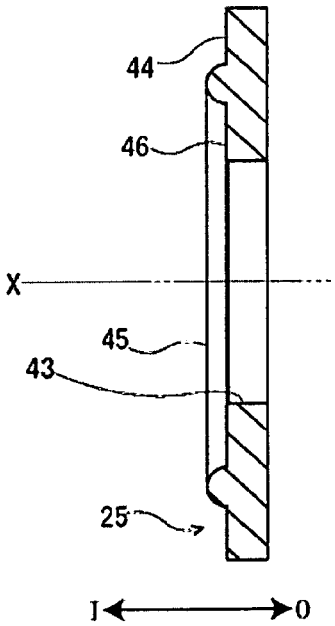
FIG. 6B is a sectional view taken along line C-C in FIG. 6A.
Figure 7:
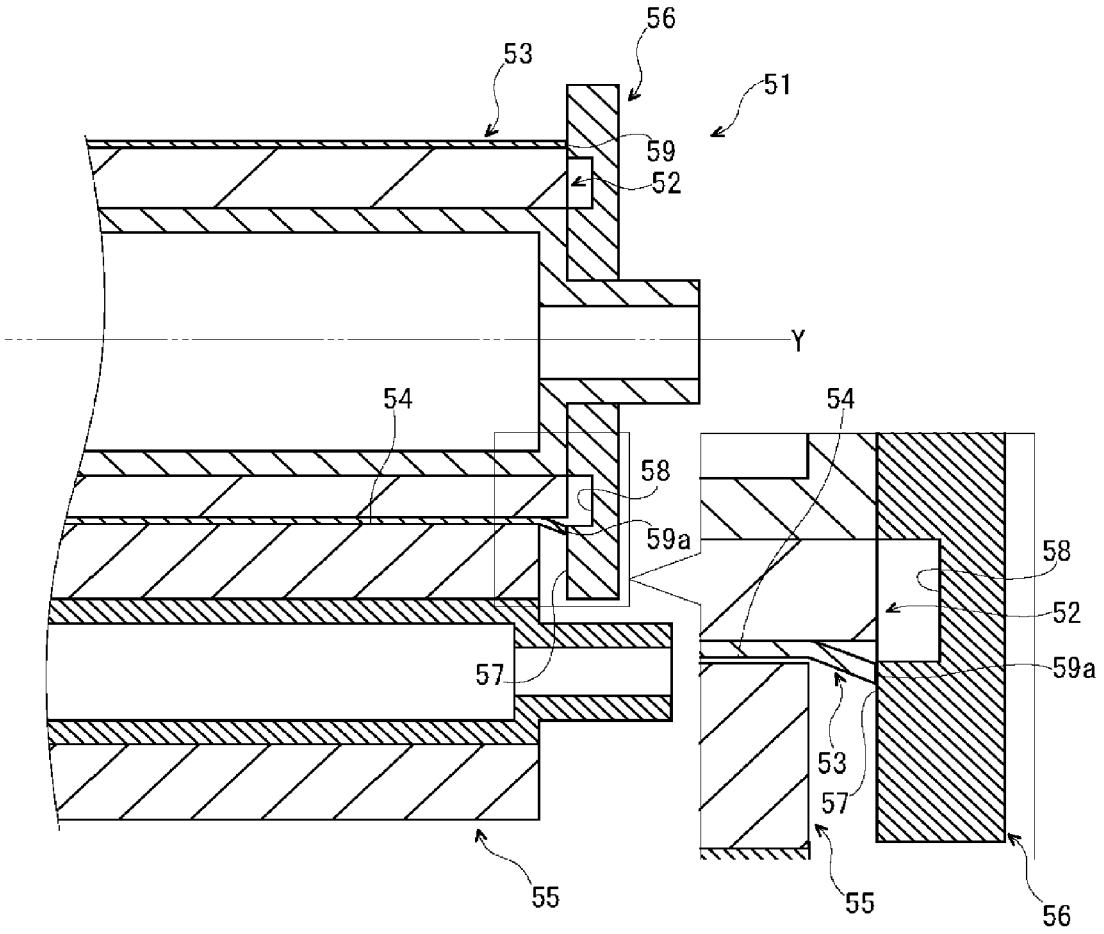
FIG. 7 is a sectional view showing one example of a fixing device.

In the present embodiment, description has been made on the instance where the respective contact portions 45 are circumferentially arranged side by side about the rotation axis X. In another embodiment, as shown in FIG. 6, a contact portion 45 may protrude from the inner surface 44 of each of the oblique motion restraint members 25 in an annular shape about the rotation axis X. By employing this configuration, as compared with the instance where the respective contact portions 45 are circumferentially arranged side by side about the rotation axis X, it is possible to simplify the shape of the respective contact portions 45 and to easily form the respective contact portions 45.

In the present embodiment, description has been made on the instance where the fixing belt 22 is installed around a single roller (the fixing roller 21). In another embodiment, the fixing belt 22 may be wound around a plurality of rollers.

In the present embodiment, description has been made on the instance where the fixing belt 22 is heated by the IH coil. In another embodiment, the fixing belt 22 may be heated by other heat sources such as a halogen heater, a ceramic heater and the like.

In the present embodiment, description has been made on the instance where the technology of the present disclosure is applied to the color printer 1. In another embodiment, the technology of the present disclosure may be applied to other image forming apparatuses such as a monochromatic printer, a copier, a facsimile machine, a composite machine and the like.

What is claimed is:

1. A fixing device, comprising:

a fixing belt configured to rotate about a specified rotation axis;

an oblique motion restraint member provided at an outer side of the fixing belt in a direction of the rotation axis and configured to restrain oblique motion of the fixing belt; and a pressing roller pressed against the fixing belt and configured to form a nip portion, wherein the oblique motion restraint member includes a flat plate portion arranged to face toward an end surface of the fixing belt in the direction of the rotation axis, a plurality of contact portions protruding from an inner surface of the flat plate portion in the direction of the rotation axis toward an inner side in the direction of the rotation axis, which are provided so as to be able to make contact with the end surface of the fixing belt, and a breakage-preventing portion, which is a portion of the inner surface of the flat plate portion in the direction of the rotation axis, located radially inward of the contact portions and more outward in the direction of the rotation axis than the contact portions, the contact portions protruding in a hemispheric shape from the inner surface of the flat plate portion of the oblique motion restraint member in the direction of the rotation axis, and circumferentially arranged side by side about the rotation axis, and configured to be able to make contact with a portion other than the nip portion of the end surface of the fixing belt in the direction of the rotation axis, the breakage-preventing portion formed in a separated state to face in the direction of the rotation axis toward a portion corresponding to the nip portion of the end surface of the fixing belt.

2. The fixing device of claim 1, wherein the contact portions are arranged with a gap therebetween.

3. The fixing device of claim 1, further comprising:

a fixing roller configured to rotate about the rotation axis, the fixing belt being installed around the fixing roller, and the oblique motion restraint member being fastened to an end portion of the fixing roller in the direction of the rotation axis.

4. An image forming apparatus comprising the fixing device of claim 1.

5. An oblique motion restraint member for a fixing belt, which is provided at an outer side of the fixing belt in a direction of a specified rotation axis about which the fixing belt rotates, the oblique motion restraint member comprising:

a flat plate portion arranged to face toward an end surface of the fixing belt in the direction of the rotation axis, a plurality of contact portions protruding from an inner surface of the flat plate portion in the direction of the rotation axis toward an inner side in the direction of the rotation axis, which are provided so as to be able to make contact with the end surface of the fixing belt, and a breakage-preventing portion, which is a portion of the inner surface of the flat plate portion in the direction of the rotation axis, located radially inward of the contact portion and more outward in the direction of the rotation axis than the contact portions, wherein the fixing belt is pressed by a pressing roller and configured to form a nip portion between the pressing roller and the fixing belt, and the contact portions are protruding in a hemispheric shape from the inner surface of the flat plate portion of the oblique motion restraint member in the direction of the rotation axis, circumferentially arranged side by side about the rotation axis, and configured to be able to make contact with a portion other than the nip portion of the end surface of the fixing belt in the direction of the rotation axis, and the breakage-preventing portion is formed in a separated state to face in the direction of the rotation axis toward a portion corresponding to the nip portion of the end surface of the fixing belt.

* * * * *